US012680307B1

(12) United States Patent
Ellison

(10) Patent No.: US 12,680,307 B1
(45) Date of Patent: Jul. 14, 2026

(54) MAGNETIC DOWNSPOUT RETENTION CLIP

(71) Applicant: John Ellison, Friend, NE (US)

(72) Inventor: John Ellison, Friend, NE (US)

( * ) Notice: Subject to any disclaimer, the term of this patent is extended or adjusted under 35 U.S.C. 154(b) by 192 days.

(21) Appl. No.: 18/349,136

(22) Filed: Jul. 8, 2023

Related U.S. Application Data

(60) Provisional application No. 63/359,235, filed on Jul. 8, 2022.

(51) Int. Cl.
*E04D 13/08* (2006.01)

(52) U.S. Cl.
CPC ..... *E04D 13/08* (2013.01); *E04D 2013/0846* (2013.01)

(58) Field of Classification Search
CPC ..... E04D 13/064; E04D 13/065; E04D 13/08; E04D 2013/082; E04D 2013/084; E04D 2013/0846; E04D 2013/086; E04D 2013/0806
See application file for complete search history.

(56) References Cited

U.S. PATENT DOCUMENTS

| | | | | |
|---|---|---|---|---|
| 3,861,419 | A * | 1/1975 | Johnson | F16L 27/0849 403/120 |
| 3,883,926 | A * | 5/1975 | Reynolds | F21V 21/088 24/339 |
| 6,357,642 | B1 * | 3/2002 | Marchessault | A45F 5/02 2/209.13 |
| 2002/0034992 | A1 * | 3/2002 | Tate | A63B 57/207 473/406 |
| 2009/0229191 | A1 * | 9/2009 | Petrov | E04D 13/0722 52/16 |
| 2014/0263895 | A1 * | 9/2014 | Dickenson | F16B 5/123 29/525.08 |
| 2021/0040744 | A1 * | 2/2021 | Aziz | E04D 13/08 |

* cited by examiner

*Primary Examiner* — Jessica L Laux
(74) *Attorney, Agent, or Firm* — McGrath North Mullin & Kratz, PC LLO; Luke C. Holst

(57) ABSTRACT

In accordance with embodiments of this disclosure, a magnetic downspout retention clip comprises: a metallic sheet forming a flat bar with two clips on opposite ends of the flat bar, wherein the two clips are configured to secure the flat bar to a distal end of a downspout; and a magnet fastened to a middle portion of the flat bar, wherein the magnet is configured to join the distal end of the downspout to an upstream portion of the downspout when the distal end of the downspout is in a raised position.

18 Claims, 9 Drawing Sheets

MAGNETIC DOWNSPOUT RETENTION CLIP

CROSS-REFERENCE TO RELATED APPLICATIONS

The present application claims priority under 35 U.S.C. § 119 (e) to U.S. Provisional Application Ser. No. 63/359,235, filed Jul. 8, 2022, and titled "MAGNETIC DOWNSPOUT RETENTION CLIP," which is incorporated herein by reference in its entirety.

TECHNICAL FIELD

The present disclosure relates to gutter systems for directing water flow from rooftops and other tall structures.

BACKGROUND

It is necessary or desirable at times to retain the distal end of a downspout of a gutter system in a raised (folded up) position. This is typically achieved using plastic clips that have a tendency to come loose or break off due to wind forces, unintentionally bumping into the downspout, or any other force exerted on the distal end of the downspout after it is clipped in place. Furthermore, the plastic clips may be flimsy and cumbersome to use. To overcome these problems, there is a need for a durable and effective means for retaining the distal end of the downspout in a raised position with capability to easily switch the distal end of the downspout back to a lowered position when desired.

SUMMARY

Aspects of this disclosure relate to a magnetic downspout retention clip that overcomes the forementioned problems of existing downspout retention clips. In embodiments, a clip body of the magnetic downspout retention clip is made of a metallic sheet that forms a flat bar with two clips on opposite ends of the flat bar, wherein the two clips are configured to secure the flat bar to a distal end of a downspout. The magnetic downspout retention clip further includes a magnet fastened to a middle portion of the flat bar, wherein the magnet is configured to join the distal end of the downspout to an upstream portion of the downspout when the distal end of the downspout is in a raised position.

This Summary is provided solely as an introduction to subject matter that is fully described in the Detailed Description and Drawings. The Summary should not be considered to describe essential features nor be used to determine the scope of the Claims. Moreover, it is to be understood that both the foregoing Summary and the following Detailed Description are example and explanatory only and are not necessarily restrictive of the subject matter claimed.

BRIEF DESCRIPTION OF THE DRAWINGS

The Detailed Description is provided with reference to the accompanying Drawings. Various embodiments or examples of the present disclosure are provided in the following Detailed Description and the accompanying Drawings. The use of the same reference numbers in different instances in the Detailed Description and the Drawings may indicate similar or identical items. The Drawings are not necessarily to scale, and any operations or steps of disclosed processes may be performed in an arbitrary order, unless otherwise indicated in the Detailed Description or in the Claims. In the Drawings:

DETAILED DESCRIPTION

Reference will now be made in detail to the subject matter disclosed, which is illustrated in the accompanying drawings.

FIGS. 1 through 7C illustrate one or more embodiments of a magnetic downspout retention clip 100 that conveniently and effectively secures the distal end of a downspout in a raised position using magnetic attraction between the clip and an upstream portion of the downspout.

Figure 1:
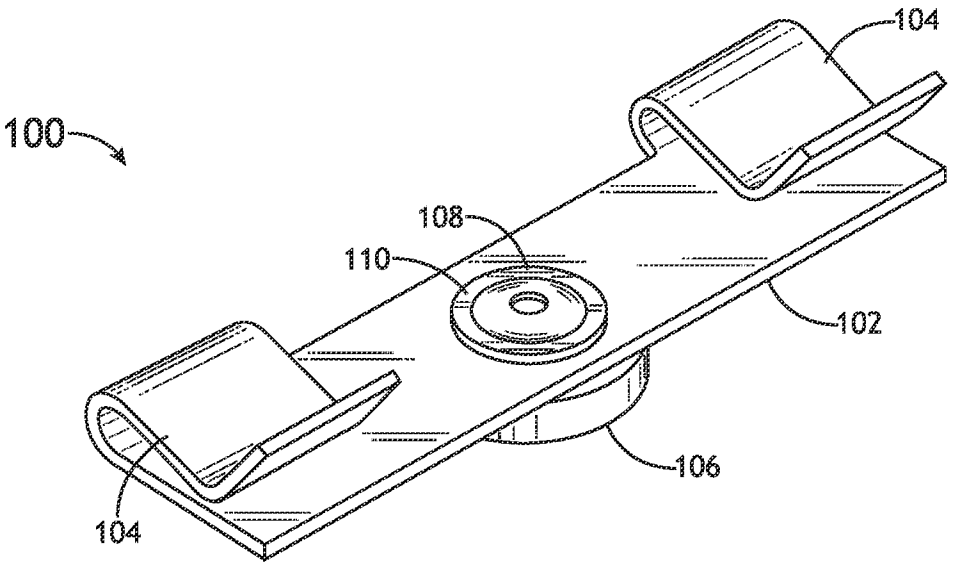
FIG. 1 is a perspective view of a magnetic downspout retention clip, in accordance with an embodiment of this disclosure.

As shown in FIG. 1, the magnetic downspout retention clip 100 comprises a clip body made of a metallic sheet that forms a flat bar 102 with two clips 104 on opposite ends of the flat bar 102. The magnetic downspout retention clip 100 further includes a magnet 106 fastened to a middle portion of the flat bar 102. As discussed in further detail below and illustrated in FIGS. 4A through 4C, the clips 104 are configured to secure the flat bar 102 to the distal end of a downspout 200, and the magnet 106 is configured to join the distal end of the downspout 200 to an upstream portion of the downspout 200 via magnetic attraction when the distal end of the downspout 200 is in a raised position.

The clip body that forms the flat bar 102 with two clips 104 on opposite ends of the flat bar 102 is preferably made of stainless steel sheet metal (e.g., 1/32 inch thick steel manufactured by Huayi International Group Ltd.), although other metals/alloys (or plastics with similar material properties) may be appropriate. FIGS. 5A through 5C and 6A through 6C show various dimensions of the clip body in inches and millimeters, respectively, in accordance with a preferred embodiment of the magnetic downspout retention clip 100. It is noted, however, that the dimensions shown in FIGS. 5A through 5C or 6A through 6C may be altered (e.g., scaled up/down or skewed) without departing from the scope of this disclosure.

The magnet 106 is preferably a cylindrical or substantially cylindrical neodymium magnet (e.g., N52 Neodymium Magnet built by Dongguan Xinyuan Magnetic Products Co. Ltd.) with a hole extending through a center of the magnet 106, although other magnetic materials and geometries may be appropriate. The inner diameter of the hole may be constant all the way through but is preferably tapered such that hole has a larger opening on one end of the magnet 106 than on the other end of the magnet 106. This allows the larger opening to receive a flared portion of a fastener 108 with the fastener 108 still being sunk into the hole, substantially flush with an outer rim of the hole, or only slightly protruding from the hole. In a preferred embodiment, the magnet 106 may have the following dimensions: 0.5 inch or 12.7 millimeter outer diameter; 0.126 inch or 3.2 millimeter thickness; 0.25 inch or 6.35 millimeter inner diameter on one end; and 0.125 inch or 3.18 millimeter inner diameter on the other end. It is noted, however, that the foregoing dimensions may be altered (e.g., scaled up/down or skewed) without departing from the scope of this disclosure.

Figure 7B:
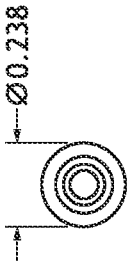
FIG. 7B is an end view of the rivet that holds together components of magnetic downspout retention clip, showing various dimensions of the rivet in inches, in accordance with an embodiment of this disclosure.
Figure 7A:
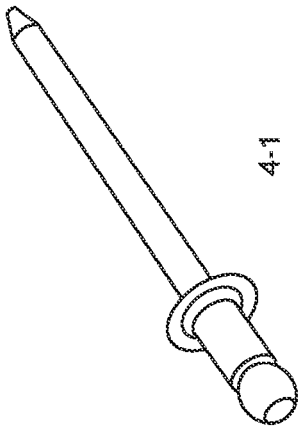
FIG. 7A is a perspective view of a rivet that holds together components of magnetic downspout retention clip, in accordance with an embodiment of this disclosure.
Figure 7C:
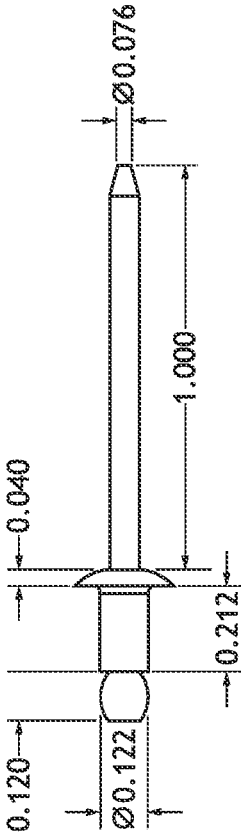
FIG. 7C is a side view of the rivet that holds together components of magnetic downspout retention clip, showing various dimensions of the rivet in inches, in accordance with an embodiment of this disclosure.

In embodiments, the magnetic downspout retention clip 100 further includes a fastener 108 extending through the hole in the magnet 106 and through another hole in the middle portion of the flat bar 102 to fasten the magnet 106 to the flat bar 102. The fastener 108 is preferably a rivet (e.g., Pop Rivet manufactured by Fastenere), although other types of fasteners (e.g., nuts and bolts) may be appropriate. For example, the fastener 108 may be a 1/8 inch×1/16 inch dome head aluminum pop rivet with a 4-1 gap. FIGS. 7A through 7C show various dimensions of the fastener 108 in inches, in accordance with a preferred embodiment of the magnetic downspout retention clip 100. It is noted, however, that the dimensions shown in FIGS. 7A through 7C may be altered (e.g., scaled up/down or skewed) without departing from the scope of this disclosure.

Figure 2B:
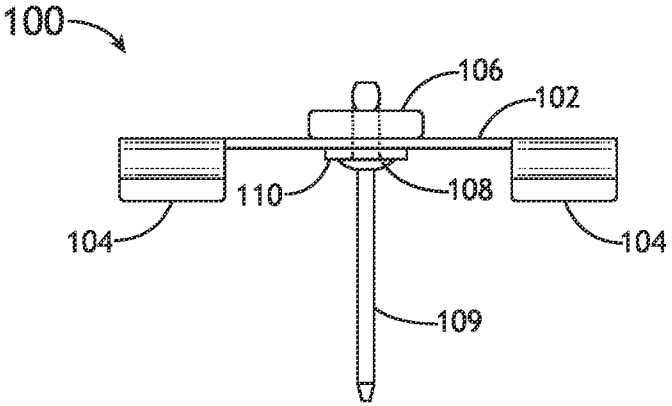
FIG. 2B is a post-assembly view of the magnetic downspout retention clip, just before the rivet mandrel is snapped off, in accordance with an embodiment of this disclosure.
Figure 2A:
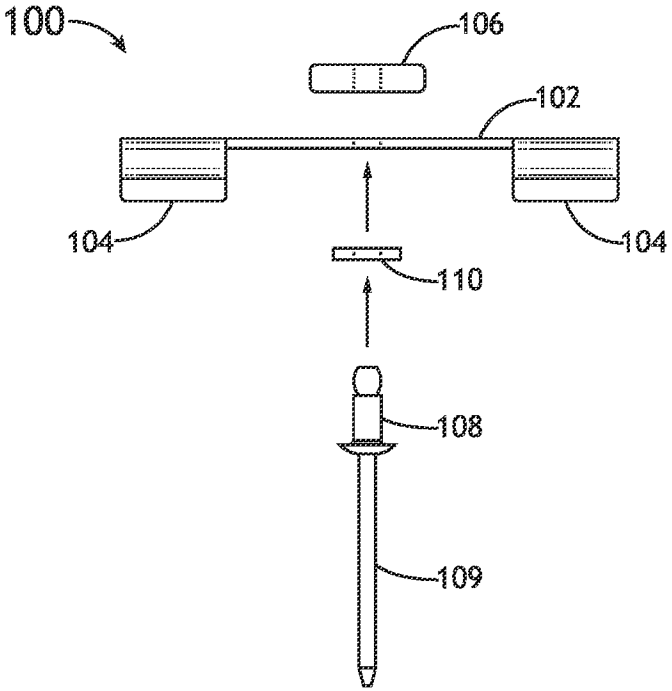
FIG. 2A is an exploded pre-assembly view of the magnetic downspout retention clip, wherein a rivet that holds other components of the clip together is fully intact with its mandrel still attached, in accordance with an embodiment of this disclosure.

FIG. 2A shows exploded pre-assembly view of the magnetic downspout retention clip 100. In some embodiments, the magnetic downspout retention clip 100 further includes a washer 110 disposed between the fastener 108 and the middle portion of the flat bar 102. The washer 110 is preferably a disk-shaped or substantially disk-shaped stainless steel washer (e.g., M3 flat washer manufactured by Uxcell). In a preferred embodiment, the washer 110 may have the following dimensions: 0.275 inch or 7 millimeter outer diameter; 0.031 inch or 0.8 millimeter thickness; and 0.125 inch or 3.2 millimeter inner diameter. It is noted, however, that the foregoing dimensions may be altered (e.g., scaled up/down or skewed) without departing from the scope of this disclosure.

The fastener 108 may extend through the washer 110, a hole in the middle portion of the fat bar 102, and the hole in the magnet 106 so that the washer 110 is held against one surface of the flat bar 102 by one end of the fastener 108, and the magnet 106 is held against an opposite surface of the flat bar 102 by an opposite end of the fastener 108, as shown in in FIG. 2B, where FIG. 2B is a post-assembly view of the magnetic downspout retention clip 100 just before a rivet mandrel 109 is snapped off, in an embodiment where the fastener 108 is a rivet.

In general, a method of producing the magnetic downspout retention clip 100 may include the following steps: (1) forming a flat bar 102 with two clips 104 on opposite ends of the flat bar 102 with a metallic sheet (e.g., with stainless steel sheet metal); and (2) fastening a magnet 106 to a middle portion of the flat bar 102, where in preferred embodiments, the magnet 106 is fastened to the middle portion of the flat bar 102 by driving a fastener 108 (e.g., rivet) through a washer 110, a hole in the middle portion of the flat bar 102, and another hole in the magnet 106 to fasten all the components together. After the components are fastened together, the rivet mandrel 109 may be snapped off, if applicable.

Figure 3B:
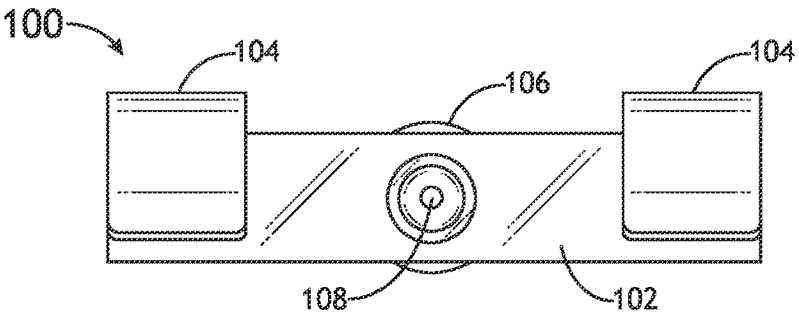
FIG. 3B is a bottom view of the magnetic downspout retention clip, in accordance with an embodiment of this disclosure.
Figure 3A:
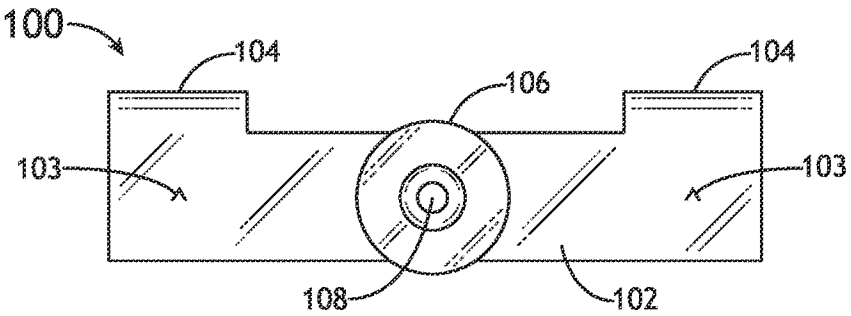
FIG. 3A is a top view of the magnetic downspout retention clip, in accordance with an embodiment of this disclosure.
Figure 3D:
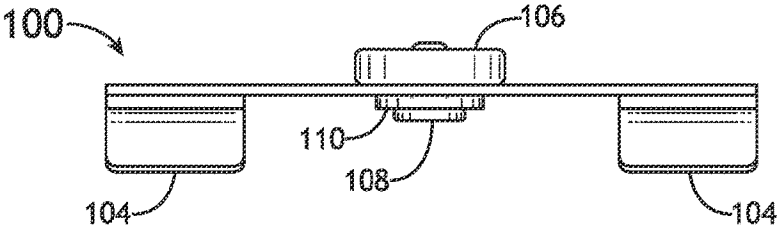
FIG. 3D is a rear elevation view of the magnetic downspout retention clip, in accordance with an embodiment of this disclosure.
Figure 3C:
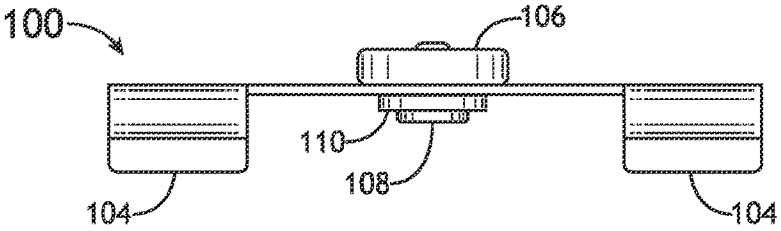
FIG. 3C is a front elevation view of the magnetic downspout retention clip, in accordance with an embodiment of this disclosure.
Figure 3F:
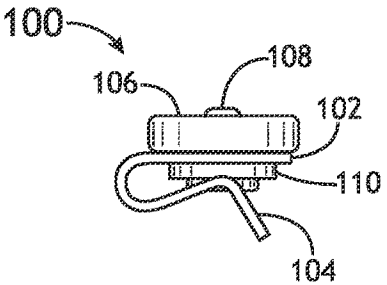
FIG. 3F is a left-side elevation view of the magnetic downspout retention clip, in accordance with an embodiment of this disclosure.
Figure 3E:
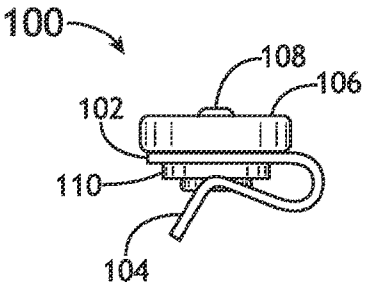
FIG. 3E is a right-side elevation view of the magnetic downspout retention clip, in accordance with an embodiment of this disclosure.

FIGS. 3A through 3F show post-assembly views of the magnetic downspout retention clip 100, where FIG. 3A is a top view of the magnetic downspout retention clip 100, FIG. 3B is a bottom view of the magnetic downspout retention clip 100, FIG. 3C is a front elevation view of the magnetic downspout retention clip 100, FIG. 3D is a rear elevation view of the magnetic downspout retention clip 100, FIG. 3E is a right-side elevation view of the magnetic downspout retention clip 100, and FIG. 3F is a left-side elevation view of the magnetic downspout retention clip of 100.

In some embodiments, the magnetic downspout retention clip 100 includes protrusions extending from a surface of the flat bar 102 under each of the two clips 104 to increase the grip/clenching power of the magnetic downspout retention clip 100. These protrusions jut out from the flat bar 102 towards the clips 104 so that flat or substantially flat objects can be clenched tightly between the protrusions and the clips 104. As shown in FIG. 3A, the protrusions may be formed by notches 103 pressed into a surface of the flat bar 102 that is opposite the surface from which the protrusions extend. The protrusions are more clearly shown in FIGS. 5B and 6B.

Figure 4A:
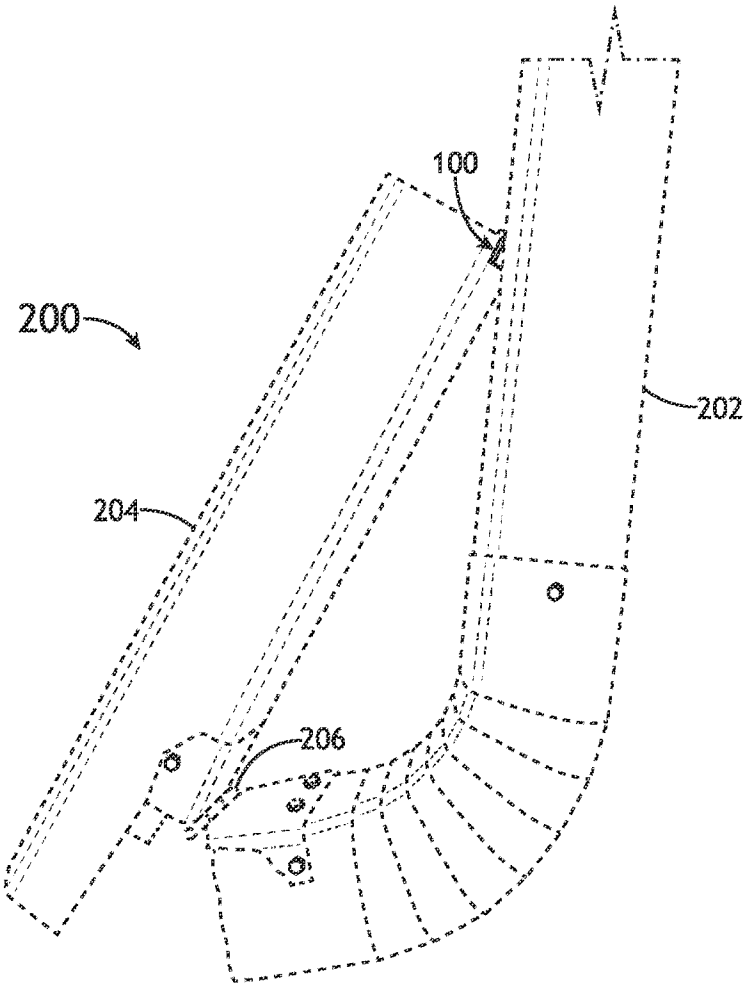
FIG. 4A is an environmental view of the magnetic downspout retention clip coupled to a downspout of a gutter system, in accordance with an embodiment of this disclosure.

FIG. 4A is an environmental view of the magnetic downspout retention clip 100 coupled to a downspout 200 of a gutter system. In embodiments, the downspout 200 of the gutter system includes a first downspout segment 202 configured to extend downwardly from a building structure, a second downspout segment 204 configured to extend away from the building structure, and a hinge 206 coupling downspout segments 202 and 204 together.

Figure 4B:
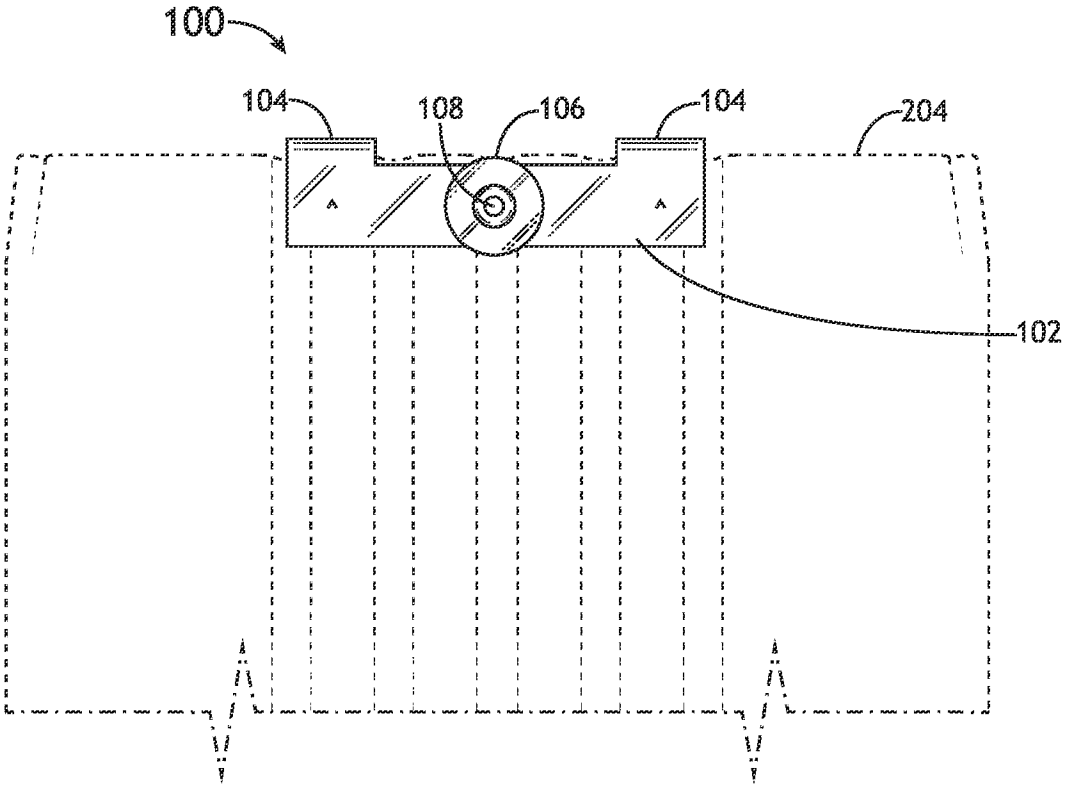
FIG. 4B is another environmental view of the magnetic downspout retention clip coupled to the downspout of the gutter system, wherein a top portion of a distal end of the downspout is shown in further detail, in accordance with an embodiment of this disclosure.
Figure 4C:
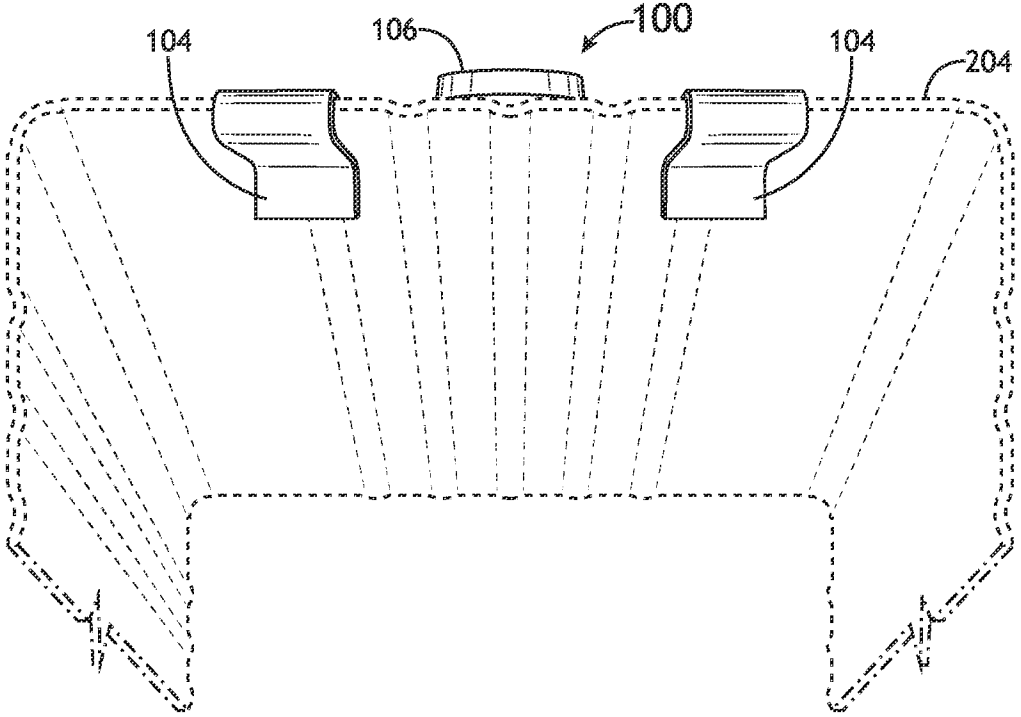
FIG. 4C is another environmental view of the magnetic downspout retention clip coupled to the downspout of the gutter system, wherein the distal end of the downspout is shown in further detail, in accordance with an embodiment of this disclosure.
Figure 5C:
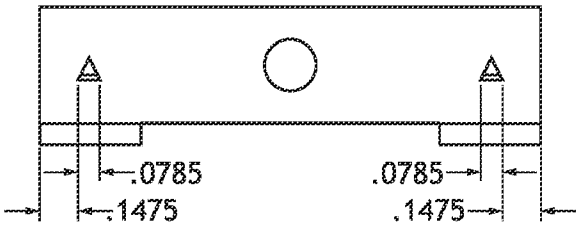
FIG. 5C is a top view of the clip body of magnetic downspout retention clip, showing various dimensions of the clip body in inches, in accordance with an embodiment of this disclosure.
Figure 5B:
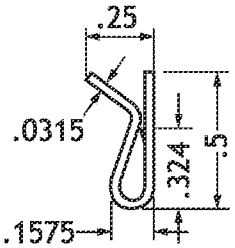
FIG. 5B is a side view of the clip body of magnetic downspout retention clip, showing various dimensions of the clip body in inches, in accordance with an embodiment of this disclosure.
Figure 5A:
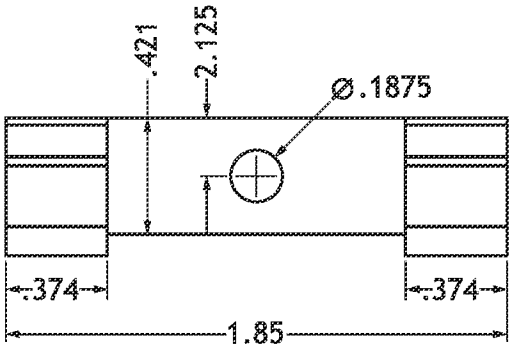
FIG. 5A is a bottom view of a clip body of magnetic downspout retention clip, showing various dimensions of the clip body in inches, in accordance with an embodiment of this disclosure.
Figure 6C:
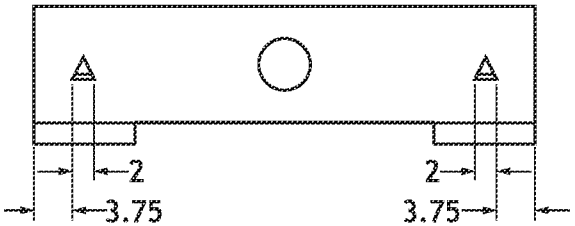
FIG. 6C is a top view of the clip body of magnetic downspout retention clip, showing various dimensions of the clip body in millimeters, in accordance with an embodiment of this disclosure.
Figure 6B:
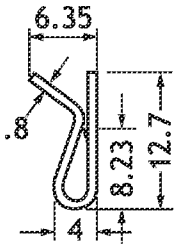
FIG. 6B is a side view of the clip body of magnetic downspout retention clip, showing various dimensions of the clip body in millimeters, in accordance with an embodiment of this disclosure.
Figure 6A:
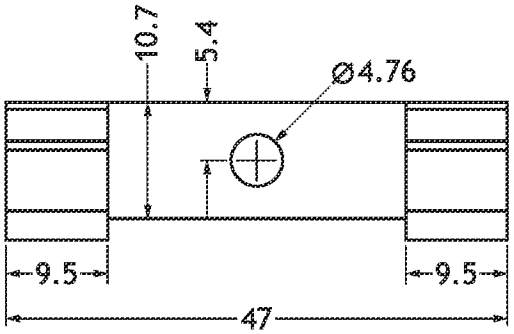
FIG. 6A is a bottom view of the clip body of magnetic downspout retention clip, showing various dimensions of the clip body in millimeters, in accordance with an embodiment of this disclosure.

As shown in FIGS. 4B and 4C, the clips 104 are configured to secure the flat bar 102 of the magnetic downspout retention clip 100 to the distal end of downspout segment 204 so that the magnet 106 can join the distal end of downspout segment 204 to an outer surface of downspout segment 202 when the distal end of downspout segment 204 is raised and placed into contact with the outer surface of downspout segment 202 (as shown in FIG. 4A).

The magnetic downspout retention clip 100 is first attached (i.e., clipped on) to the distal end of downspout segment 204. Then, when downspout segment 204 is raised, the clip's magnet 106 joins the distal end of downspout segment 204 to downspout segment 202. Because the downspout 200 is an entirely metallic structure, the magnet 106 forms a strong attraction between itself and both portions of the downspout 200 that it is in contact with (i.e., the distal end of downspout segment 204 that it is clipped onto and the upstream portion of the downspout (downspout segment 202) that it is brought into contact with when downspout segment 204 is raised). In this manner, downspout segment 204 can be conveniently raised and then retained in its raised position via magnetic attraction between the magnet 106 and downspout segment 202. The distal end of the downspout 200 can be returned to its lowered position just as easily. When the distal end of downspout segment 204 is forcibly pulled away from downspout segment 202, the magnetic attraction can be overcome so that the distal end of the downspout 200 (i.e., distal end of downspout segment 204) may be returned to its lowered position.

The magnetic downspout retention clip 100, as described above, is made of durable materials and allows users to quickly transition the distal end of the downspout 200 between raised and lowered positions without needing to perform any mechanical fastening/unfastening steps other than the initial clipping of the magnetic downspout retention clip 100 onto the distal end of the downspout 200. This provides significant advantages over plastic clips, screws, and other types of mechanical fasteners that are currently available for retaining a distal end of a downspout in a raised position.

Although the technology has been described with reference to the embodiments illustrated in the attached drawing figures, equivalents may be employed, and substitutions may be made herein without departing from the scope of the technology as recited in the claims. Components illustrated and described herein are examples of devices and components that may be used to implement the embodiments of the present invention and may be replaced with other devices and components without departing from the scope of the invention. Furthermore, any dimensions, degrees, and/or numerical ranges provided herein are to be understood as non-limiting examples unless otherwise specified in the claims.

What is claimed is:

1. A magnetic downspout retention clip, comprising:

a metallic sheet forming a flat bar with two clips on opposite ends of the flat bar, wherein the two clips are configured to secure the flat bar to a distal end of a downspout;

a magnet fastened to a middle portion of the flat bar, wherein the magnet is configured to join the distal end of the downspout to an upstream portion of the downspout when the distal end of the downspout is in a raised position; and protrusions extending from a surface of the flat bar under each of the two clips.

2. The magnetic downspout retention clip of claim 1, wherein the magnet is a neodymium magnet.

3. The magnetic downspout retention clip of claim 1, wherein the magnet includes a hole extending through a center of the magnet.

4. The magnetic downspout retention clip of claim 3, further comprising:

a fastener extending through the hole in the magnet and through another hole in the middle portion of the flat bar to fasten the magnet to the flat bar.

5. The magnetic downspout retention clip of claim 4, wherein the fastener is a rivet.

6. The magnetic downspout retention clip of claim 4, further comprising:

a washer disposed between the fastener and the middle portion of the flat bar.

7. The magnetic downspout retention clip of claim 6, wherein the washer is held against one surface of the flat bar by one end of the fastener, and the magnet is held against an opposite surface of the flat bar by an opposite end of the fastener.

8. The magnetic downspout retention clip of claim 1, wherein the protrusions are formed by notches pressed into an opposite surface of the flat bar.

9. A gutter system, comprising:

a first downspout segment configured to extend downwardly from a building structure;

a second downspout segment configured to extend away from the building structure;

a hinge coupling the first downspout segment and the second downspout segment together; and a magnetic downspout retention clip, comprising:

a metallic sheet forming a flat bar with two clips on opposite ends of the flat bar, wherein the two clips are configured to secure the flat bar to a distal end of the second downspout segment;

protrusions extending from a surface of the flat bar under each of the two clips; and a magnet fastened to a middle portion of the flat bar, wherein the magnet is configured to join the distal end of the second downspout segment to an outer surface of the first downspout segment when the second downspout segment is in a raised position.

10. The gutter system of claim 9, wherein the magnet is a neodymium magnet.

11. The gutter system of claim 9, wherein the magnet includes a hole extending through a center of the magnet.

12. The gutter system of claim 11, wherein the magnetic downspout retention clip further comprises:

a fastener extending through the hole in the magnet and through another hole in the middle portion of the flat bar to fasten the magnet to the flat bar.

13. The gutter system of claim 12, wherein the fastener is a rivet.

14. The gutter system of claim 12, wherein the magnetic downspout retention clip further comprises:

a washer disposed between the fastener and the middle portion of the flat bar.

15. The gutter system of claim 14, wherein the washer is held against one surface of the flat bar by one end of the fastener, and the magnet is held against an opposite surface of the flat bar by an opposite end of the fastener.

16. The gutter system of claim 9, wherein the protrusions are formed by notches pressed into an opposite surface of the flat bar.

17. A method of producing a magnetic downspout retention clip, the method comprising steps of:

forming a flat bar with two clips on opposite ends of the flat bar with a metallic sheet and protrusions extending from a surface of the flat bar under each of the two clips, wherein the two clips are configured to secure the flat bar to a distal end of a downspout; and fastening a magnet to a middle portion of the flat bar, wherein the magnet is configured to join the distal end of the downspout to an upstream portion of the downspout when the distal end of the downspout is in a raised position.

18. The method of claim 17, wherein the magnet is fastened to the middle portion of the flat bar by driving a rivet through a washer, a hole in the middle portion of the flat bar, and another hole in the magnet.

* * * * *